US007585229B2

(12) United States Patent
Kelley

(10) Patent No.: US 7,585,229 B2
(45) Date of Patent: Sep. 8, 2009

(54) GOLF TRAINING DEVICE FOR CHIPPING AND PUTTING

(76) Inventor: Patrick Thomas Hersom Kelley, 1624 Nasturtium Way, Apex, NC (US) 27539

( * ) Notice: Subject to any disclaimer, the term of this patent is extended or adjusted under 35 U.S.C. 154(b) by 0 days.

(21) Appl. No.: 11/461,358

(22) Filed: Jul. 31, 2006

(65) Prior Publication Data

US 2008/0026865 A1 Jan. 31, 2008

(51) Int. Cl.
*A63B 69/36* (2006.01)

(52) U.S. Cl. ..... 473/276; 473/212

(58) Field of Classification Search ..... 473/212, 473/215, 266, 276, 277, 201, 207
See application file for complete search history.

(56) References Cited

U.S. PATENT DOCUMENTS

| | | | | | |
|---|---|---|---|---|---|
| 1,699,219 | A * | 1/1929 | Bemish et al. | ..... | 473/212 |
| 1,973,240 | A * | 9/1934 | Proudfit et al. | ..... | 27/13 |
| 3,672,682 | A * | 6/1972 | Yanagidaira | ..... | 473/276 |
| 3,820,781 | A * | 6/1974 | Kane | ..... | 482/93 |
| 4,045,033 | A * | 8/1977 | Schuman | ..... | 473/266 |
| 4,203,433 | A * | 5/1980 | Prahl | ..... | 602/24 |
| 4,321,890 | A * | 3/1982 | Lange et al. | ..... | 119/712 |
| 4,576,155 | A * | 3/1986 | Levy | ..... | 128/869 |
| 4,581,754 | A * | 4/1986 | Donovan | ..... | 378/208 |
| 4,896,887 | A * | 1/1990 | Cable | ..... | 473/212 |
| 5,096,199 | A * | 3/1992 | Wyatt et al. | ..... | 473/212 |
| 5,125,844 | A | 6/1992 | Grant et al. | | |
| 5,145,179 | A | 9/1992 | Breed | | |
| 5,203,567 | A * | 4/1993 | Erlinger et al. | ..... | 473/276 |
| 5,320,354 | A | 6/1994 | Vasquez | | |
| 5,795,238 | A | 8/1998 | Nicholson | | |
| 5,853,335 | A | 12/1998 | Self | | |
| 6,036,608 | A | 3/2000 | Morris | | |
| 6,554,718 | B2 * | 4/2003 | Back | ..... | 473/276 |
| 6,561,920 | B1 | 5/2003 | Hamilton | | |
| 6,863,616 | B2 | 3/2005 | Snyder et al. | | |
| 6,994,633 | B2 | 2/2006 | Czaja et al. | | |

* cited by examiner

*Primary Examiner*—Nini Legesse
(74) *Attorney, Agent, or Firm*—Jim Passé; Passé Intellectual Property, LLC.

(57) ABSTRACT

The invention relates to a training device to be used by a golfer to help the golfer develop proper arm motion and placement during putting and chipping comprising a rigid lateral spacing member having a distal side and a proximal side, the member including a pair of upper arm cradling means in the distal side for holding the upper arms in spaced relationship to the chest and to each other and a chest cradling means on the proximal side for placing the device against the mid chest and holding the arms in spaced relationship to the mid chest during use.

7 Claims, 3 Drawing Sheets

GOLF TRAINING DEVICE FOR CHIPPING AND PUTTING

BACKGROUND OF THE INVENTION

1. Field of the Invention

The invention relates to a training device to be used by a golfer to help the golfer develop proper arm motion and placement during putting and chipping. More particularly, the invention relates to a device which trains the golfer to hold the arms in proper relationship to each other and to the player's chest.

2. Description of the Related Art

While in its simplest form, golf is a game of hitting a golf ball into a hole with a club, the use of several different clubs is necessary to master the game as the player stokes the ball from different distances and under different circumstances. Golf requires that the player be able to take full swings with the golf clubs as well as pitch, chip and put and it is extremely important for mastery of the game to make these strokes in a consistent and precise manner. During the full swing and partial swing of pitching the relationship of the arms to each other and to the body changes throughout the stroke. However chipping and putting share that the arms and shoulders need to move together with the shoulders as a unit as the ball is hit.

A check of the patents issued in the golf training area reveals that there are literally hundreds of devices, machines and apparatus designed to improve the swing for driving and pitching. See for example U.S. Pat. No. 6,863,616 to Snyder et al and U.S. Pat. No. 6,994,663. Some of these devices are relatively small and simple mechanically while others are large machines designed to control the whole body movement.

Much less work has been done on the putting and chipping stroke. This is despite the fact that since both putting and chipping are done close to the hole, they require much more precise movements to achieve the accuracy necessary for a successful game and training of the golfer for these activities would have a much greater positive impact on the golfers total score. Inventions known in the putting and chipping area fall into 3 basic categories. The first category is putting and chipping targets. Target inventions are devices designed to put and chip the ball towards for practice in distance and range accuracy. In U.S. Pat. No. 5,853,335 there is described a target base for practicing pitching and chipping skills.

A second category are devices for training the golfer to move the club in a straight line. In U.S. Pat. No. 5,125,844 there is claimed a housing with an actuating device communicating with a stoke arm rigidly securing a golf club arm. In U.S. Pat. No. 6,036,608 there is a U-shaped base with a parallel with battery operated laser. Lastly, in U.S. Pat. No. 6,561,920 there is described a putting guide that is placed on the ground between the golfer and the golf ball.

A last category are those devices which train the positioning of the arms relative to one another during putting and chipping. Even here a number of approaches have been used. In U.S. Pat. No. 5,145,179 to Breed discloses a training device which includes a laterally adjustable spacing member, a pair of pivotally adjustable forearm bracing members attached on opposing ends with an adjustable strap on one of the bracing members for securing the device to the users forearm. The device positions the forearms in spaced relationship to each other but not in relationship to the body. In U.S. Pat. No. 5,320,354 to Vasquez there is described a golf training device wherein an elongated support member having a cap on its upper end is held against the grip of a golf club with the cap engaging the upper end of the grip. A single adjustable link extends from the cap at a right angle to the elongated support and terminates at an arm pad which positions the golfer's lower leading arm. In U.S. Pat. No. 5,795,238 to Nicholson, there is described a device which includes a flexible strap having a shoulder portion, a first arm portion and an attachment device for attaching the first arm portion to a golfers arm and a second arm portion and finger strap for attaching the second arm portion to a golfer's hand in order to maintain the golfers wrist in a flexed position during the putting stoke. The device attempts to keep a fixed relationship between the users' arms and shoulders but not between the arms and the body.

As can be seen each device attempts to work on different relationship issues of the golfer goes through the putting motion. Some share the difficulty of having to attaché the device directly to the club and they all seem to have forgotten the important relationship between the position of the arms relative to the chest. They all require tedious adjustment and in some cases construction to use. While that is helpful with the bigger devices it is certainly an impediment to regular use of a training device. It also leaves it up to the user to pick the proper adjustment to get the proper swing thus defeating the purpose of the device, that is, to have the device show the user what the position should be.

The overall limiting of body motion should be limited by the design of the device and not how the user puts it together. Further since travel is a part of the sport of golf it is an important aspect of a training device that it be easy to transport with little or no assembly required.

SUMMARY OF THE INVENTION

It is an object of the present invention to provide an improved golf training device for use in practicing pitching and putting which fixes the relationship both between each arm but between the users arms and body as well. The device is easy to use and transport, needs no adjustment, is lightweight and easy to manufacture.

Accordingly, the present invention provides a golf training device for improving the swing during chipping and putting comprising:

A rigid lateral spacing member having a distal side and a proximal side, the member including a pair of upper arm cradling means in the distal side for holding the upper arms in spaced relationship to the chest and to each other and a chest cradling means on the proximal side for placing the device against the mid chest and holding the arms in spaced relationship to the mid chest during use.

DETAILED DESRIPTION OF THE INVENTION

Figure 1A:
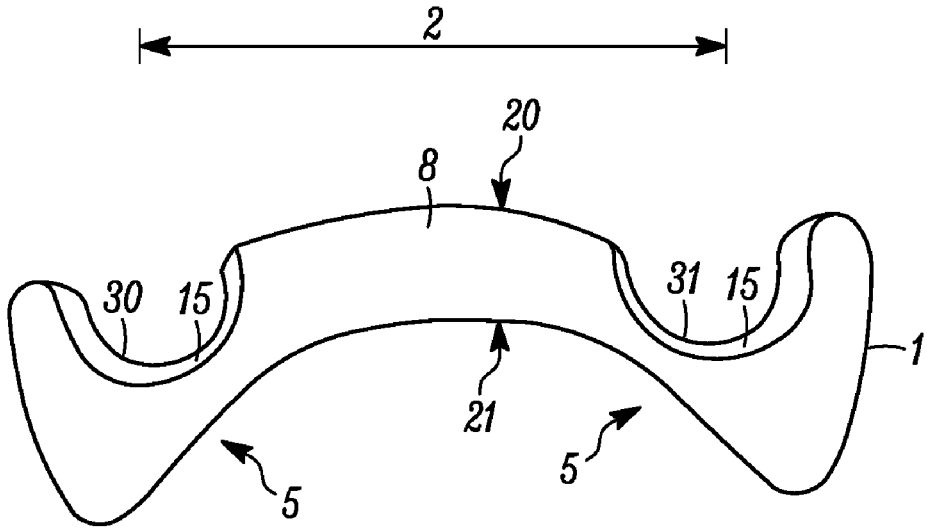
FIG. 1*a* is a top perspective view of the invention.

The present invention is a golf training device designed to improve the swing for chipping and putting. It has the advantage over previous devices in that among other things it does not need adjustment and therefore can not be misadjusted, it is easy to manufacture, it provides training for the proper distance to keep both the arms separated and the arms away from the chest, can be manufactured from a wide variety of materials and can easily be transported and even carried in the golf bag. The general description of the training device is stated in the Brief Summary above. This detailed description defines the meaning of the terms used herein and specifically describes embodiments in order for those skilled in the art to practice the invention.

The device is primarily designed to properly space the arms and space the distance between the arms and the chest during a golf swing. By "rigid lateral spacing member" as used herein is meant a means for spacing the arms just above the elbows a proper distance for chipping and putting. This is normally approximately 8 to 14 inches depending on the individual. In one embodiment of the invention the distance is approximately 12 inches. While other devices measure between the forearms, the present invention places the spacing member on the upper arm thus avoiding interference with the forearms during the golf swing. By rigid is meant a very high resistance to flexing such as would be exhibited by materials such as wood, metals such as aluminum and rigid plastics such as expanded polystyrene (Styrofoam), polyethylene and polypropylene. Other rigid materials are well known and could also be substituted herein as well such as metals, such as iron, steel copper lead gold silver tin or the like; soap, paper maché, fiberglass, cardboard resin and resin impregnated materials and porcelain. The spacing means is wider than the means to space the arms and thus is wider than the 8 to 12 inches of the spacing means or approximately 10 to 20 inches in width in most cases. Again a much larger person or a child for example would use proportionately larger or smaller dimensions.

By "distal side" and "proximal side" as used herein is meant the side of the device closest to and farthest away from the body respectively. The proximal side can be straight cut or in another embodiment the proximal side is beveled to match the contour of the golfer's chest and the point of contact between the proximal side and the golfer's chest. While depending on where that occurs and depending on the physicality of the golfer the exact bevel may change in general when beveling is used in one embodiment it is between zero degrees and about 85 degrees of bevel. In one embodiment the bevel is about 10 to 40 degrees and in yet another embodiment the bevel is about 15 degrees to about 25 degrees away from the body to match the approximate contour between the upper chest and the stomach where the device often meets the chest.

By "pair of upper arm cradling means" as used herein is meant a means positioned on the distal side of the lateral spacing member for holding the upper arms just above the elbow in relatively fixed spaced relationship to each other and to the chest. This is approximately 8 to 14 inches apart and one to 3 inches away from the chest. In one embodiment of the cradling means there are cut outs on the distal side of the spacing means corresponding to the circumference of the upper arm that the user's arms fit into (see figures which follow). Other means could be used such as straps and other cradling means. In addition, the cradling means can be beveled away from the golfer's chest to hold the golfers arm at the correct angle and spacing from the golfer's chest. When beveling is used it is in one embodiment between zero degrees and about 85 degrees of bevel. In one embodiment the bevel is about 10 to 40 degrees and in yet another embodiment the bevel is about 15 degrees to about 25 degrees away from the body to match the approximate contour between the device and the upper arms.

By "chest cradling means" is meant herein that the proximal side of the lateral spacing member is so contoured such that the proximal side comfortably and relatively snugly fits against the mid-chest during use. This is accomplished by contouring the proximal side in a left to right curve that approximates the curve of the chest. It can also be beveled as previously discussed above.

The thickness of the device is designed to both accommodate the arms, aid in rigidity as well as provide sufficient bevel to properly position the device and the upper arms. In most cases this should be one to three inches but more or less thickness can be used depending on the exact arm and chest cradling means used. While normally the device can be held in place with the arms and pressure against the chest other options such as an attachment means such as a strap or the like could also be used which would leave the device in place even when the user did not have their arms in the cradling means.

Figure 1B:
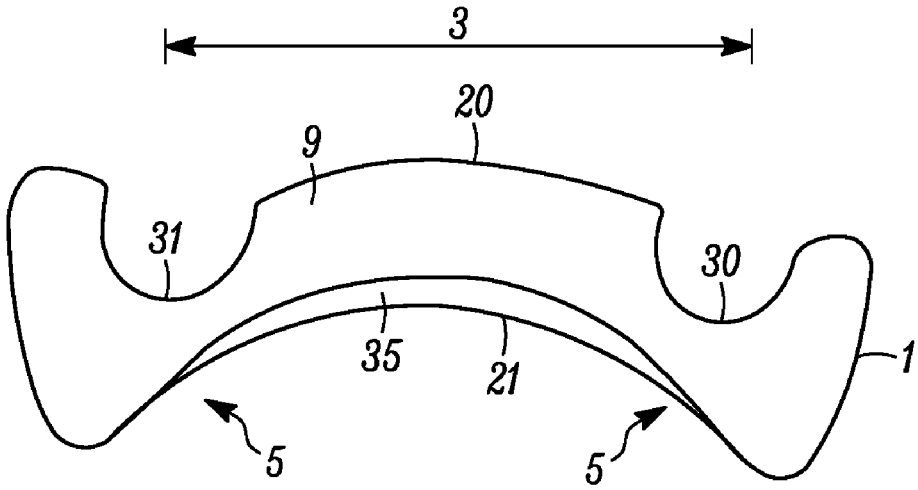
FIG. 1*b* is a bottom perspective of the invention.

Now referring to the embodiments depicted in the drawings, like numbers in each drawing refer to like features described in the description. FIGS. 1*a* and 1*b* are top and bottom views respectively of a device of the invention. In FIG. 1*a* the top 8 of the golf training device 1 is a flat surface of a device made out of for example wood. The distal side 20 and proximal side 21 are shown from the top. The chest cradling means 5 is represented in this embodiment by the curvature of the golf training device 1 proximal side 21 which should match the normal chest curvature. The upper arm cradling means is represented by left arm 30 and right arm 31 cradling means. Each of the users' upper arms just above the elbow fits in the respective left and right arm cradling means. In this embodiment the beveling 31 is shown which angles the arm away from the body, in this embodiment approximately 15 degrees. The lateral spacing member 2 is shown as the portion of the golf training device between the two arm cradling means 30 and 31. In FIG. 1*b* the bottom side 9 of the golf training device 1 is shown. The beveling 15 from the arm cradling means in FIG. 1*a* is not visible from this view. However the chest beveling 35 of the chest cradling means 5 is clearly visible from this view. In this embodiment the angle is approximately 15 degrees.

Figure 2:
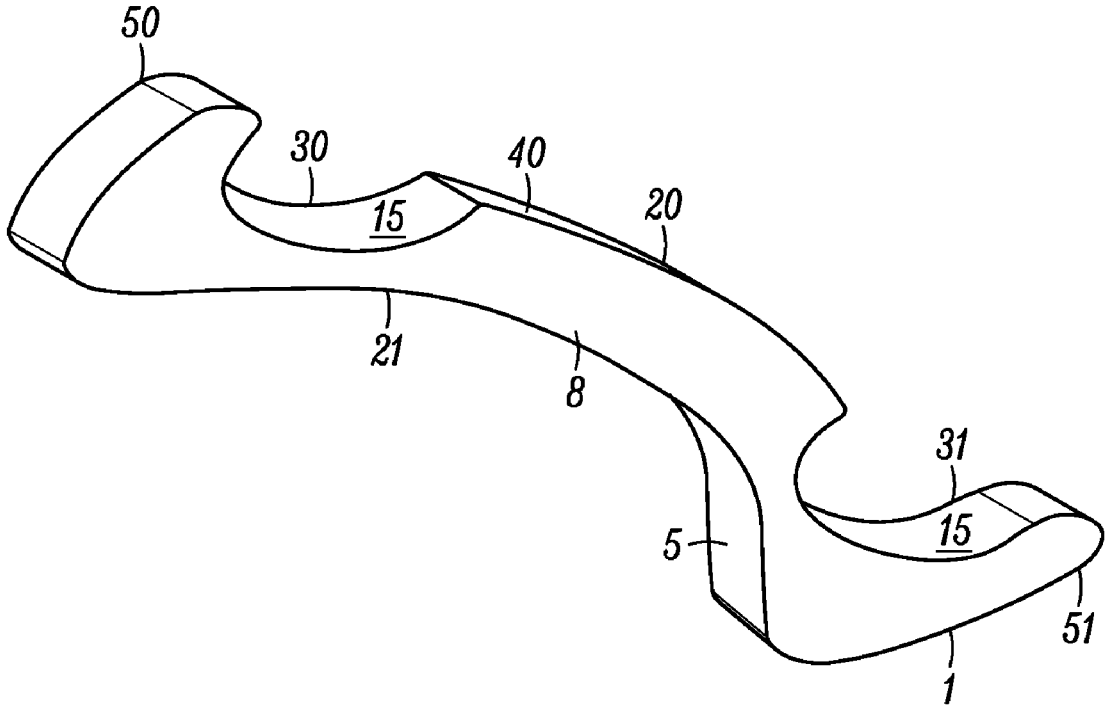
FIG. 2 is a perspective view of the invention.

FIG. 2 is a full perspective of the golf training device 1. The same features as in FIGS. 1*a* and 1*b* are shown but in more 3-dimentional detail for the upper arm cradling means 30 and 31 (left and right respectively). In this perspective the thickness 40 of the device can be seen. In this embodiment it is 1 and a half inches thick and the entire device is 18 inches in length from left side 50 to right side 51.

Figure 3A:
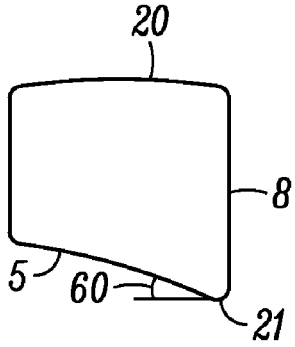
FIG. 3*a* is cross sectional view through the middle of a device of the invention.
Figure 3B:
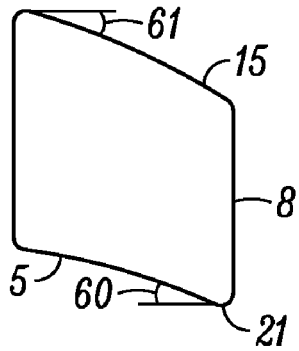
FIG. 3*b* is a cross sectional view through one of the arm cradling means.

FIG. 3*a* is a cross cut view through the device at the point labeled 40 in FIG. 2. The beveled edge 5 can be seen from the edge and the 15 degree from level beveling angle 60 is depicted. Likewise FIG. 3*b* is a cross cut view through the arm cradling means 30. Here the arm cradling bevel 61 is shown as is the chest cradling bevel 60.

Figure 4:
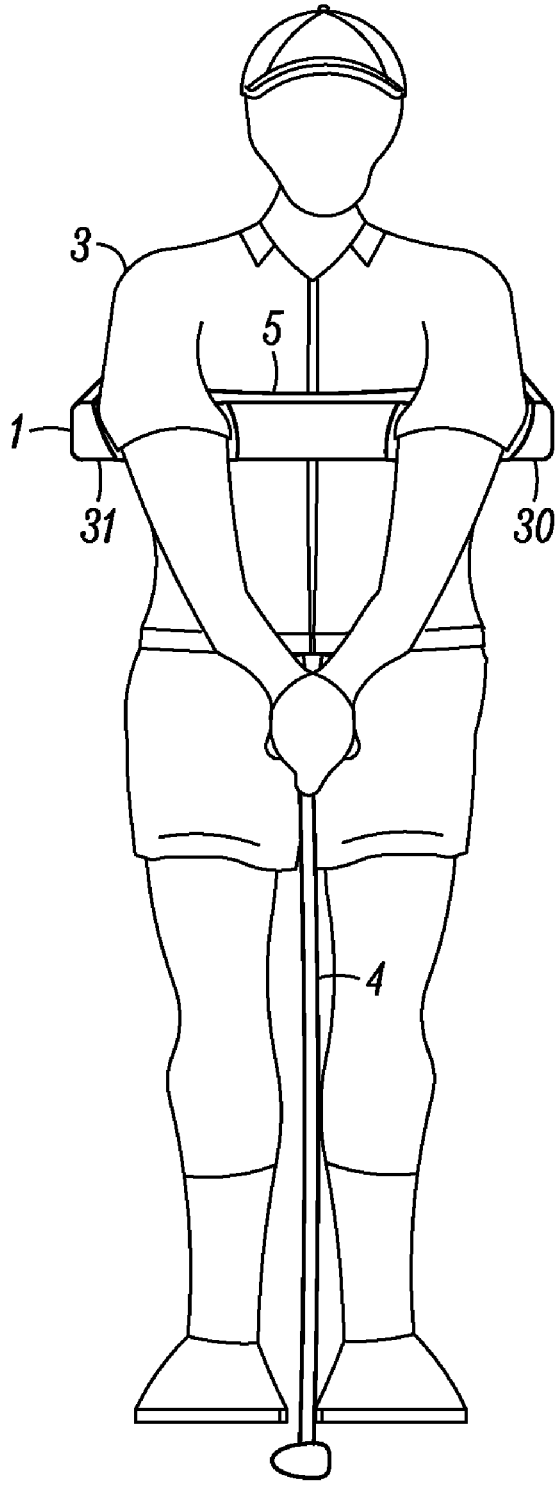
FIG. 4 is a perspective in the hands of a golfer.

Lastly FIG. 4 depicts golfer 3 holding golf club 4 with golf training device 1 in position in use spacing the arms just above the elbows The left and right arms are positioned in upper arm cradling means left 30 and right 31 (from the golfers view). The chest cradling means 5is placed firmly against the golfer's chest. From this position the golfer merely brings the club back and follows through and the device of the invention keeps the arms in proper relationship. On skilled in the art could clearly make changes in materials design accommodation for different size golfers and the like from the disclosure and embodiments depicted in the drawings. The drawings are thus not intended to be limiting embodiments of the invention.

What is claimed is:

1. A golf training device for improving the swing during chipping and putting by a golfer consisting of:

a) a rigid lateral spacing member having a distal side and a proximal side;

b) a pair of semicircular upper arm cradling means in the distal side of the spacing member for holding the upper arms in fixed spaced relationship to the chest of the golfer and to each other, beveled to angle the upper arm away from the body of the golfer at a desirable angle for a golf swing and positioned such that at least a portion of the upper arm is in front of the golfer's chest;

c) a chest cradling means on the proximal side of the spacing member for placing the device against the mid chest of the golfer and holding the arms in fixed spaced relationship to the mid chest of the golfer; and d) the device is of a height that when the upper arms of the golfer are in the cradling means during use the device is positioned entirely above the elbow.

2. A golf training device according to claim 1 wherein the spacing member chest cradling means is beveled to match the mid chest body angle during use.

3. A golf training device according to claim 1 which is made from a rigid material that the training device is made from is selected from wood, metal or plastic.

4. A golf training device according to claim 1 wherein the lateral spacing member is approximately chest wide.

5. A golf training device according to claim 1 wherein the lateral spacing device is approximately one half to 3 inches in depth.

6. A device according to claim 1 wherein the upper arm cradling means holds the arms approximately one half to 3 inches away from the body.

7. A device according to claim 1 wherein the height of the device is from about one to three inches.

* * * * *